US011541679B2

(12) United States Patent
Eriksson

(10) Patent No.: US 11,541,679 B2
(45) Date of Patent: Jan. 3, 2023

(54) DEVICE AND METHOD FOR SIMULTANEOUS SQUARE FOLDING OF THE SPINE AND TRIMMING OF BOOKLETS

(71) Applicant: Plockmatic International AB, Hagersten (SE)

(72) Inventor: Lennart Eriksson, Segeltorp (SE)

(73) Assignee: Plockmatic International AB, Hägersten (SE)

( * ) Notice: Subject to any disclaimer, the term of this patent is extended or adjusted under 35 U.S.C. 154(b) by 0 days.

(21) Appl. No.: 17/250,908

(22) PCT Filed: Sep. 30, 2019

(86) PCT No.: PCT/EP2019/076347
§ 371 (c)(1),
(2) Date: Mar. 25, 2021

(87) PCT Pub. No.: WO2020/065084
PCT Pub. Date: Apr. 2, 2020

(65) Prior Publication Data

US 2022/0024240 A1 Jan. 27, 2022

(30) Foreign Application Priority Data

Sep. 28, 2018 (SE) ..... 1851173-3

(51) Int. Cl.
*B42C 5/02* (2006.01)
*B26D 1/08* (2006.01)
(Continued)

(52) U.S. Cl.
CPC ..... *B42C 5/02* (2013.01); *B26D 1/08* (2013.01); *B26D 5/42* (2013.01); *B26D 7/0675* (2013.01);
(Continued)

(58) Field of Classification Search
CPC .. B42C 5/02; B42C 19/08; B42C 3/00; B42C 1/12; B31F 1/0035; B31F 2201/0794;
(Continued)

(56) References Cited

U.S. PATENT DOCUMENTS 6,708,967 B1 3/2004 Trovinger et al.
7,431,273 B2 * 10/2008 Kamiya ..... B42C 5/02 270/32
(Continued)

FOREIGN PATENT DOCUMENTS

EP 1780036 A2 5/2007
JP 2007137665 A * 6/2007
(Continued)

OTHER PUBLICATIONS

Espacenet machine translation of JP2007137665A; http://translationportal.epo.org/emtp/translate/?ACTION=description-retrieval&COUNTRY=JP&ENGINE=google&FORMAT=docdb&KIND=A&LOCALE=en_EP&NUMBER=2007137665&OPS=ops.epo.org/3.2&SRCLANG=ja&TRGLANG=en (Year: 2007).*
(Continued)

*Primary Examiner* — Leslie A Nicholson, III
(74) *Attorney, Agent, or Firm* — Brake Hughes Bellermann LLP

(57) ABSTRACT

A post-processing device (1) for simultaneously performing both square folding and trimming of a booklet (3), wherein the device (1) comprises a square folding assembly (8) and a cutting assembly (5) at least one of which is movably attached to the post-processing device (1), and a clamping assembly (17) for holding the booklet (3) static during operation of the square folding assembly (8) and the cutting assembly (5). Also, a method of operating such a device (1).

18 Claims, 5 Drawing Sheets

(51) Int. Cl.

| | |
|---|---|
| ***B26D 5/42*** | (2006.01) |
| ***B26D 7/06*** | (2006.01) |
| ***B42C 1/12*** | (2006.01) |
| ***B42C 3/00*** | (2006.01) |
| ***B42C 19/08*** | (2006.01) |

(52) U.S. Cl.
CPC ..... *B42C 1/12* (2013.01); *B42C 3/00* (2013.01); *B42C 19/08* (2013.01)

(58) Field of Classification Search
CPC ..... B65H 45/12; B65H 2301/51232; B65H 2701/13212; B26D 7/0675; B26D 5/42; B26D 1/08
See application file for complete search history.

(56) References Cited

U.S. PATENT DOCUMENTS

| | | | | |
|---|---|---|---|---|
| 7,891,928 | B2 | 2/2011 | Harada | |
| 8,191,882 | B2 * | 6/2012 | Kikkawa | B65H 45/18 270/32 |
| 8,474,807 | B2 * | 7/2013 | Asami | B42C 7/004 270/45 |
| 8,573,581 | B2 * | 11/2013 | Suzuki | B65H 9/004 270/32 |
| 8,662,487 | B2 * | 3/2014 | Watanabe | B31F 7/00 270/32 |
| 9,174,814 | B2 * | 11/2015 | Kayaba | B65H 5/32 |
| 2002/0061238 | A1 | 5/2002 | Marsh | |
| 2007/0120310 | A1 | 5/2007 | Awano | |
| 2009/0221411 | A1 | 9/2009 | Endo | |
| 2010/0239393 | A1 | 9/2010 | Suzuki et al. | |
| 2010/0247203 | A1 | 9/2010 | Watanabe et al. | |
| 2010/0258994 | A1 | 10/2010 | Kikkawa et al. | |

FOREIGN PATENT DOCUMENTS

| | | | | |
|---|---|---|---|---|
| JP | 2007223777 | A | * | 9/2007 |
| JP | 2008127122 | A | * | 6/2008 |
| JP | 2009113150 | A | | 5/2009 |
| WO | 2010013440 | A1 | | 2/2010 |

OTHER PUBLICATIONS

International Search Report and Written Opinion for Application No. PCT/EP2019/076347, dated Jan. 15, 2020, 9 pages.
Notice and Swedish Search Report for Swedish Patent Appln. No. 1851173-3 dated Mar. 28, 2019, 7 pages.

* cited by examiner

DEVICE AND METHOD FOR SIMULTANEOUS SQUARE FOLDING OF THE SPINE AND TRIMMING OF BOOKLETS

CROSS REFERENCE TO RELATED APPLICATIONS

This application is a 35 U.S.C. § 371 National Phase Entry Application from PCT Application No. PCT/EP2019/076347, filed on Sep. 30, 2019, entitled "DEVICE AND METHOD FOR SIMULATANEOUS SQUARE FOLDING OF THE SPINE AND TRIMMING OF BOOKLETS", and designating the U.S., which claims priority to Swedish Application No. 1851173-3, filed on Sep. 28, 2018, the disclosures of which are incorporated herein in their entireties by reference.

The present invention relates to a post-processing device for printed booklets. Specifically, the device relates to such a device configured to perform both square folding and trimming of the printed booklet.

BACKGROUND

Image forming devices, such as printers, are commonly combined with post-processing devices configured to perform post-processing operations such as folding and stacking of papers into a booklet, binding of sheets of the booklet by stapling, trimming edges of the booklet and square folding the bound edge of the booklet. Typically, such post-processing machines are adapted to receive papers from an input side, such as a right-hand side, and output the processed papers on an output side, such as a left-hand side. Several machines are therefore connected in series after each other, each machine having its own function, such as one machine for folding, one machine for squarefolding and one machine for trimming.

An example of a machine performing both squarefolding and trimming is disclosed in U.S. Pat. No. 7,891,928 B2. Another example of a machine performing both squarefolding and trimming is disclosed in U.S. Pat. No. 9,174,814 B2.

It is an object of the invention to provide a smaller yet fast machine capable of squarefolding and trimming a booklet.

SUMMARY

These and other objects are achieved by a device and a method according to a first and a second aspect of the invention, respectively.

A post-processing device according to the first aspect of the invention is defined in claim 1 with embodiments described in the dependent claims 2-7. The device comprises:

an inlet for receiving a booklet to be post-processed, an outlet for outputting the booklet after post-processing, a cutting assembly comprising a knife and a support, a square folding assembly comprising a press means for applying pressure along the spine of the booklet, a conveying system configured to move the booklet along a transportation path from the inlet to the outlet via the cutting assembly and the square folding assembly, and a clamping assembly configured to be operable between an open a clamping position in which the clamping assembly clamps the spine portion of the booklet to hold the booklet static in a processing position for processing by the square folding assembly and the cutting assembly, and an open position in which the clamping assembly allows the booklet to move. The cutting assembly and/or the square folding assembly is/are movably attached to the post-processing device such that the distance between the square folding assembly and the cutting assembly is variable by movement of at least one of the cutting assembly and the square folding assembly. By making the cutting assembly and/or the square folding assembly movably attached to the post-processing device such that the distance between the square folding assembly and the cutting assembly is variable, the machine is able to both square fold and trim booklets of varying size whilst keeping the booklet held static for both operations. This enables faster post-processing and enables both functions on a smaller footprint whilst still allowing for processing of a wide range of sizes of booklets.

Upon selection of a new booklet size to process, the distance between the cutting assembly and the square folding assembly is adjusted such that the distance is adapted for a booklet in the processing position to extend at least partly through the cutting assembly for cutting away the outer portion of the sheets of the booklet. This distance between the cutting assembly and the square folding assembly is then kept during post-processing of a plurality of booklets, until the booklet size is changed.

The conveying system may comprise a first feeding assembly provided between the inlet and the cutting assembly, wherein the first feeding assembly comprises a first feeding mechanism configured to control feeding of the booklet relative to the first feeding assembly, wherein the first feeding assembly is movably attached to the post-processing device and guided for movement back and forth along the transportation path between the inlet and the cutting assembly, wherein the conveying system comprises a second feeding assembly provided between the cutting assembly and the square folding assembly, and wherein the second feeding assembly comprises a second feeding mechanism configured to control feeding of the booklet relative to the second feeding assembly.

The first feeding assembly receives a front portion of a booklet through the inlet of the post-processing device and grabs the booklet. From there, the booklet is moved by the first feeding assembly to the cutting assembly. Once by the cutting assembly, the feeding mechanism of the first feeding assembly is activated to feed the booklet forward through the open cutting assembly until the booklet reaches the second feeding assembly which grabs the front portion of the booklet. It should be understood that the total distance that the booklet has to travel from the inlet to reach the second feeding assembly may be greater, equal or less than the width of the booklet. Once grabbed by the second feeding assembly, the second feeding assembly is able to feed the booklet all the way to the processing position, either by operation of the feeding mechanism of the second feeding assembly or by translation of the second feeding assembly or both operation of the feeding mechanism and translation of the second feeding assembly. Since the distance between the cutting assembly and the square folding assembly is less than the width of the booklet (it always is, due to the initial width setup upon change of booklet size as described above) and since the second feeding assembly is positioned between the cutting assembly and the square folding assembly, the second feeding assembly does not have to move in order to convey the booklet to the processing position but can simply feed the booklet forward to the processing position.

Hence, the provision of the first feeding assembly and second feeding assembly so configured enables automated movement of booklets of varying size whilst allowing the cutting assembly to be static during post-processing of a plurality of booklets of the same size. The cutting assembly is heavy and not having to move it for each booklet processed is a great advantage, reducing processing times, vibrations and wear on the machine.

The second feeding assembly may be movably attached to the post-processing device and guided for movement back and forth along the transportation path between the cutting assembly and the square folding assembly.

By making the second feeding assembly movable back and forth along the transportation path between the cutting assembly and the square folding assembly, the booklet can be moved by the second feeding assembly to its processing position, whilst grabbing hold of the folded portion of the booklet, by mere translation of the second feeding assembly rather than by operation of the feeding mechanism of the second feeding assembly. Moving a booklet by pulling its folded portion brings about a stable movement of the booklet with reduced risk of forcing sheets to deform.

The clamping assembly may be provided adjacent the square folding assembly.

Clamping the booklet close to the square folding assembly enables clamping of the folded portion of the booklet along its spine, which in turn enables distinct creasing action by the square folding assembly.

The first feeding assembly may be mounted on a linear guide and wherein the first feeding mechanism is configured such that a forward feeding direction of the first feeding mechanism is parallel to the direction of the linear guide.

The provision of a linear guide and such alignment of the feeding direction and the direction of the linear guide enables feeding along the transportation path at any position of the respective feeding assembly by operation of the feeding mechanism of the respective feeding assembly. This enables a higher degree of selective positioning of the booklet independently of the positioning of the first feeding assembly, which in turn enables a faster operation of the machine since both feeding actions of the feeding assembly (feeding by operation of feeding mechanism and by translation of the feeding assembly) can be performed at the same time. Also, after initial receipt of a booklet from the inlet, the first feeding assembly will be able to operate its feeding mechanism further away from the cutting assembly without feeding the booklet obliquely off its transportation path into contact with the knife or the support of the cutting assembly, which could be the case in the feeding direction was not aligned with the direction of movement of the feeding assembly.

The post-processing device may further comprise a stopper means comprising an abutment member movable between a stop position in which it blocks the transportation path at a position adjacent the square folding assembly to thereby define the processing position, and a resting position in which the abutment member is moved out of the way of the square folding assembly such that the square folding assembly is free to operate on the booklet.

The provision of such a stopper means enables the booklet to be fed by the second feeding assembly until the booklet hits the abutment member at a given position corresponding to the processing position.

The abutment member may be parallel to the knife of the cutting assembly. The parallelism enables skew of the booklet to be corrected by forcing the booklet against the abutment member using the second feeding assembly before trimming and square folding, thus reducing risk of wrongly directed cuts and poor creasing.

A method according to the second aspect of the invention is defined in claim 8 with embodiments defined in the dependent claim 9. The method of operating the post-processing device according to the second aspect comprises the steps of:

b) moving the square folding assembly and/or the cutting assembly to be a predetermined distance apart, c) operating the first feeding assembly to receive, grab and convey a booklet from the inlet to the cutting assembly, d) operating the first feeding mechanism to move the booklet forward relative to the first feeding assembly until the booklet is within reach of the second feeding assembly, e) operating the second feeding assembly to grab and convey the booklet from the cutting assembly to the processing position, f) operating the clamping assembly to clamp the booklet in the processing position, h) operating the square folding assembly and the cutting assembly to square fold and cut the booklet respectively whilst clamped in the processing position, i) operating the clamping assembly to bring it to its open position, and j) operating the second feeding assembly to convey the booklet towards the outlet.

In step b), the distance between the square folding assembly and the cutting assembly is adjusted to a distance suitable for simultaneous processing by the square folding assembly and the cutting assembly depending on the size of the booklet to be processed and particularly of how much of the booklet it to be left after cutting. The overhang to be cut off can depend on many factors, such as the number of sheets making up the booklet and the thickness of each respective sheet. Hence, after setting the distance, a plurality of similar booklets may be processed by repeating the other steps.

If the post-processing device comprises the stopper means described above, the method may further comprise a step a) to be performed any time before step d), said step a) comprising operating the stopper means to bring the abutment member to the stop position, thereby providing a physical stop defining the processing position, wherein the method further comprises between steps f) and h) a step g) of operating the stopper means to move the abutment member to its resting position.

BRIEF DESCRIPTION OF DRAWINGS

FIG. 1 shows the post-processing device with arrows indicating movable parts.

FIGS. 2-10 show consecutive steps of operation of the post-processing device.

FIG. 2 shows the device with the stopper means moved to its stop position and the cutting assembly moved to a suitable position set apart a distance D1 from the square folding assembly. Also, the first feeding assembly is moved to the inlet and the first feeding mechanism opened to allow a booklet to enter the first feeding mechanism. Further, the clamping assembly is opened to allow insertion of a booklet.

FIG. 3 shows a booklet entering the first feeding assembly through the inlet.

FIG. 4 shows movement of the booklet to the cutting assembly by translation of the first feeding assembly. Also, positioning of the second feeding assembly to receive the booklet.

FIG. 5 shows feeding of the booklet from the first feeding assembly to the second feeding assembly through the open cutting assembly.

FIG. 6 shows movement of the booklet to the processing position by translation of the second feeding assembly until the booklet hits the abutment member of the stopper means.

FIG. 7 shows operation of the clamping assembly to clamp the booklet in the processing position.

FIG. 8 shows operation of the stopper means to its resting position, allowing the square folding assembly subsequent access to the folded portion of the booklet.

FIG. 9 shows simultaneous operation of the square folding assembly and the cutting assembly.

FIG. 10 shows opening of the clamping assembly and subsequent conveying of the booklet towards the outlet.

Figure 1:
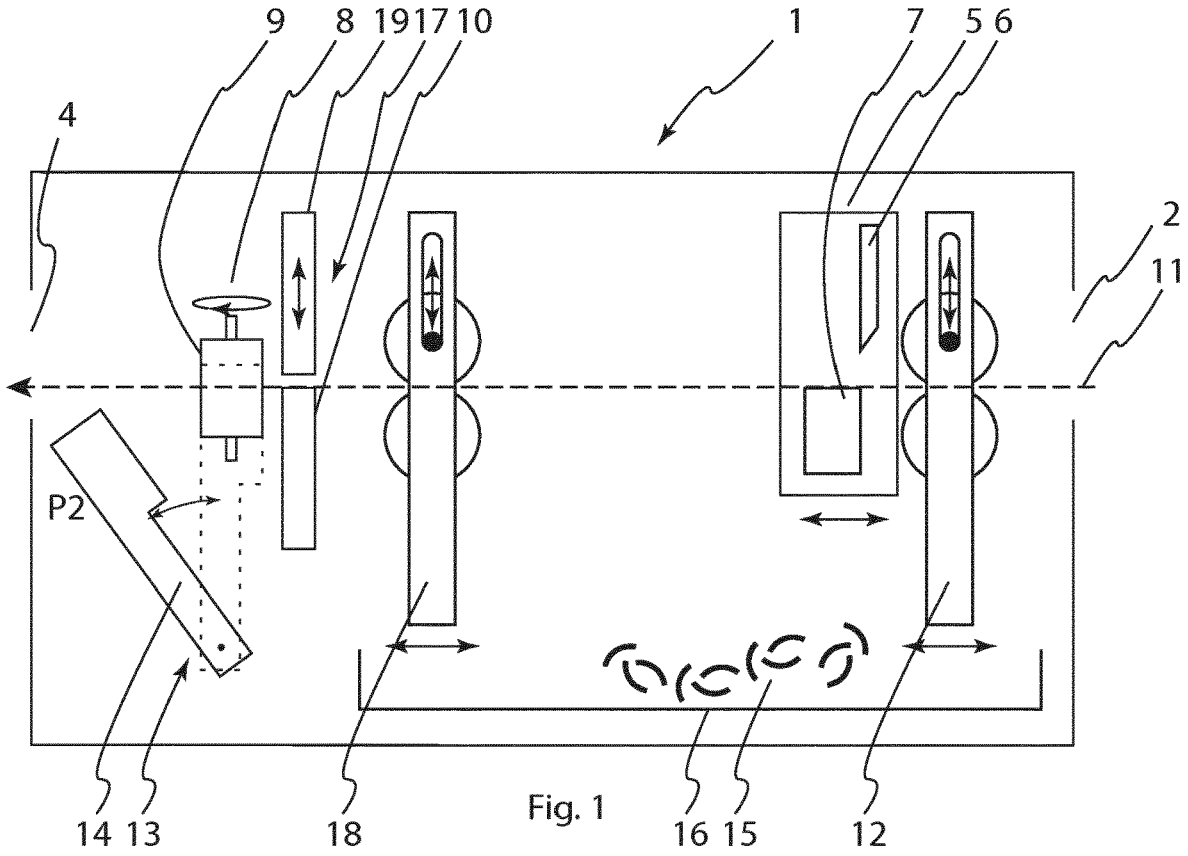
FIGS. 1-10 show schematic views of a first embodiment of the post-processing device.
Figure 2:
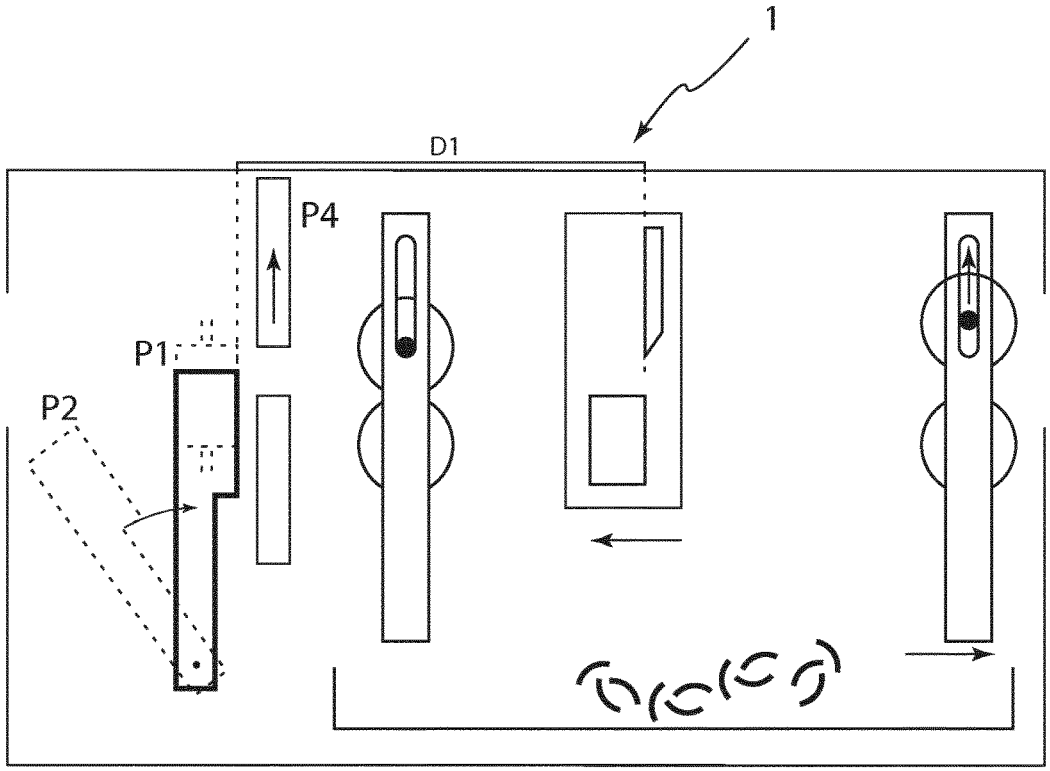
Figure 3:
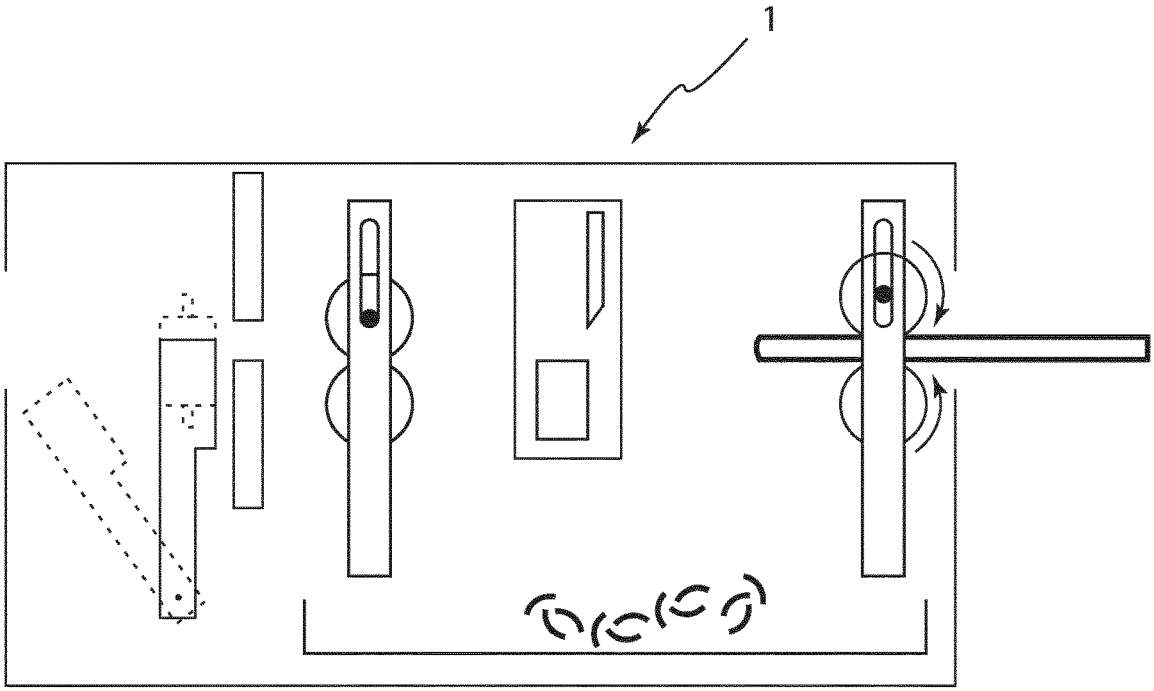
Figure 4:
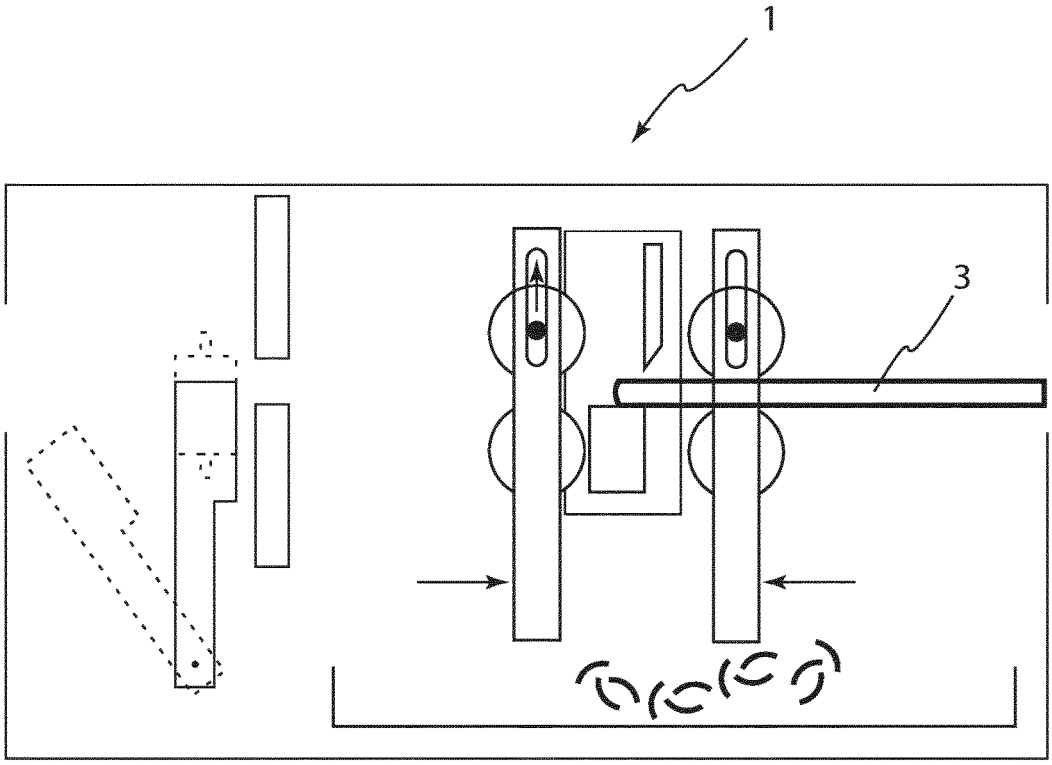
Figure 5:
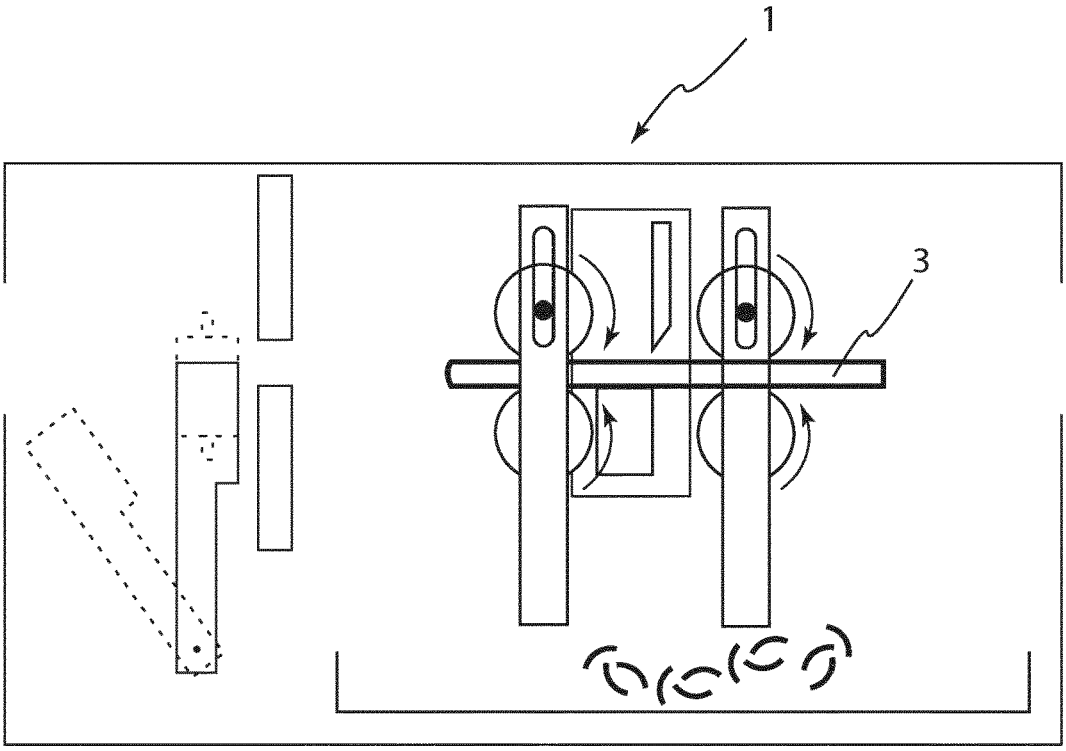
Figure 6:
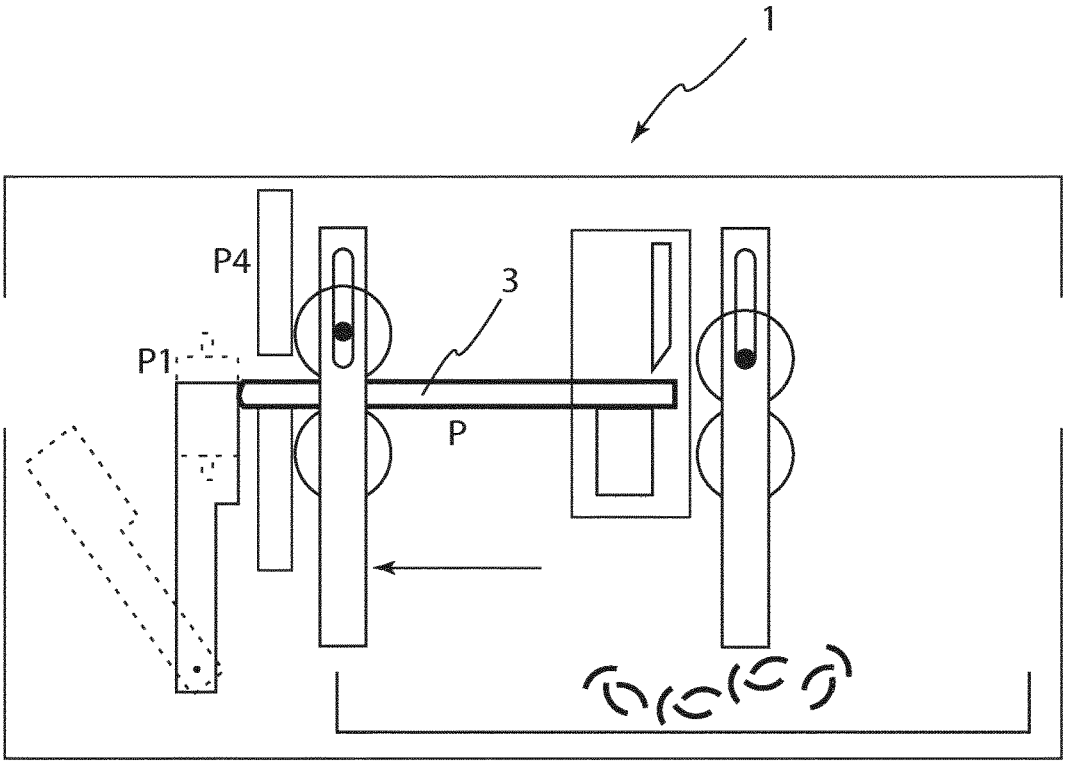
Figure 7:
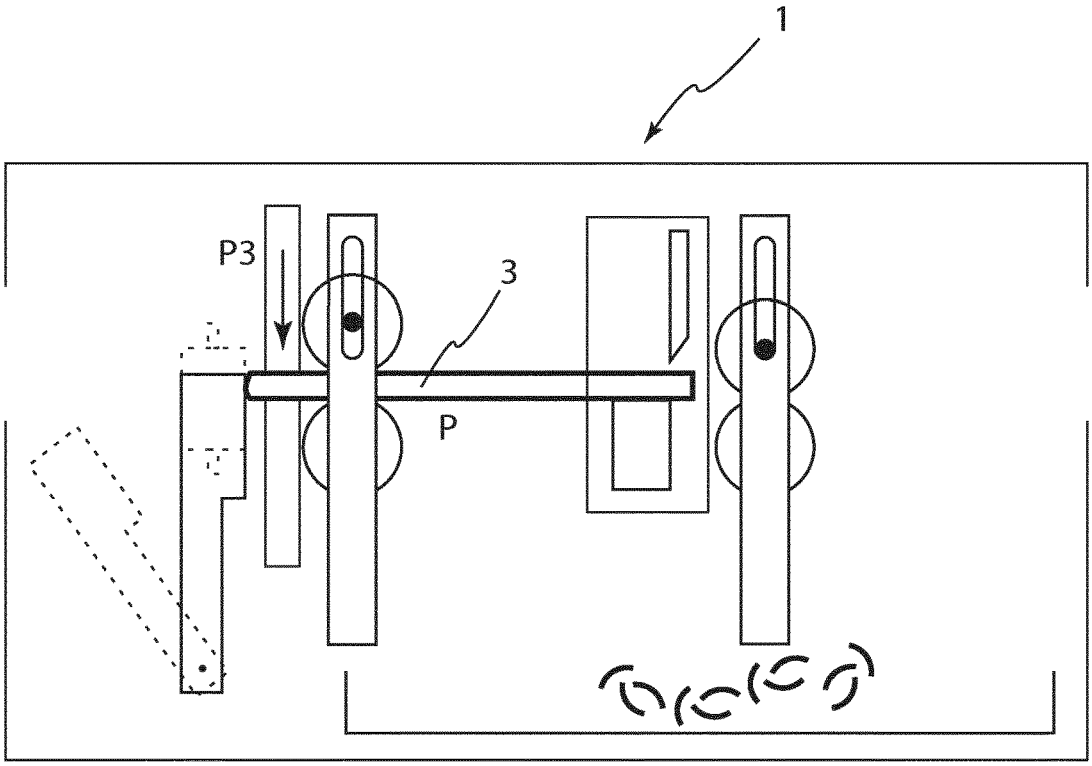
Figure 8:
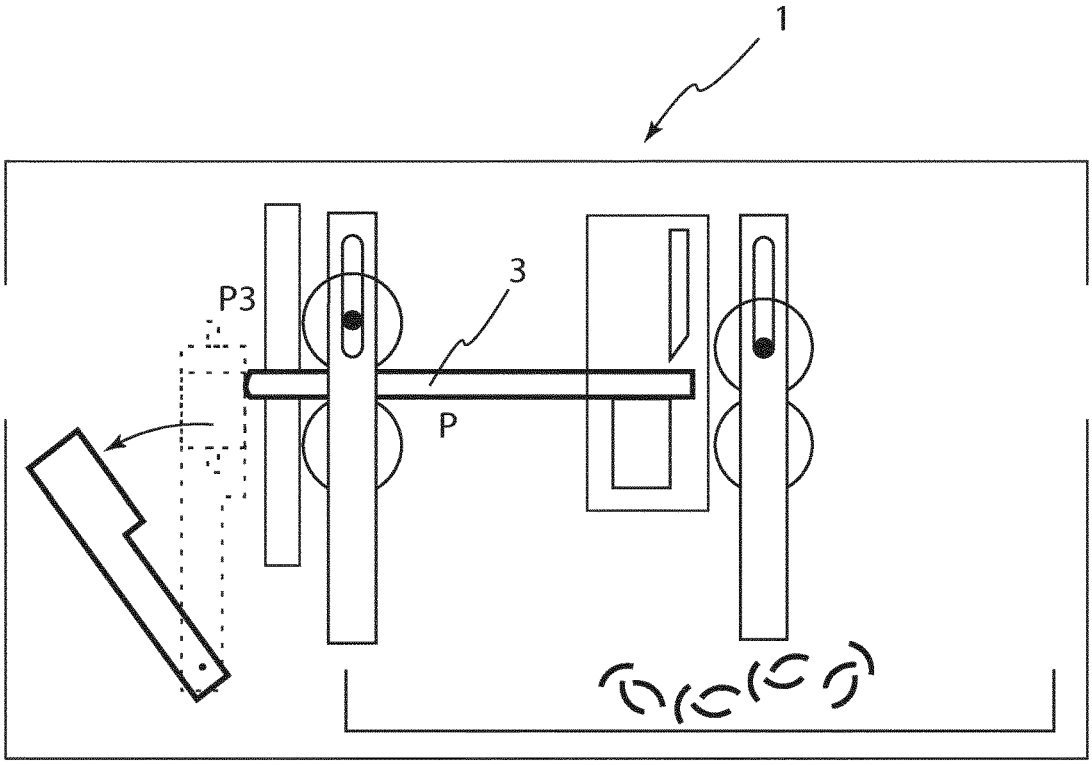
Figure 9:
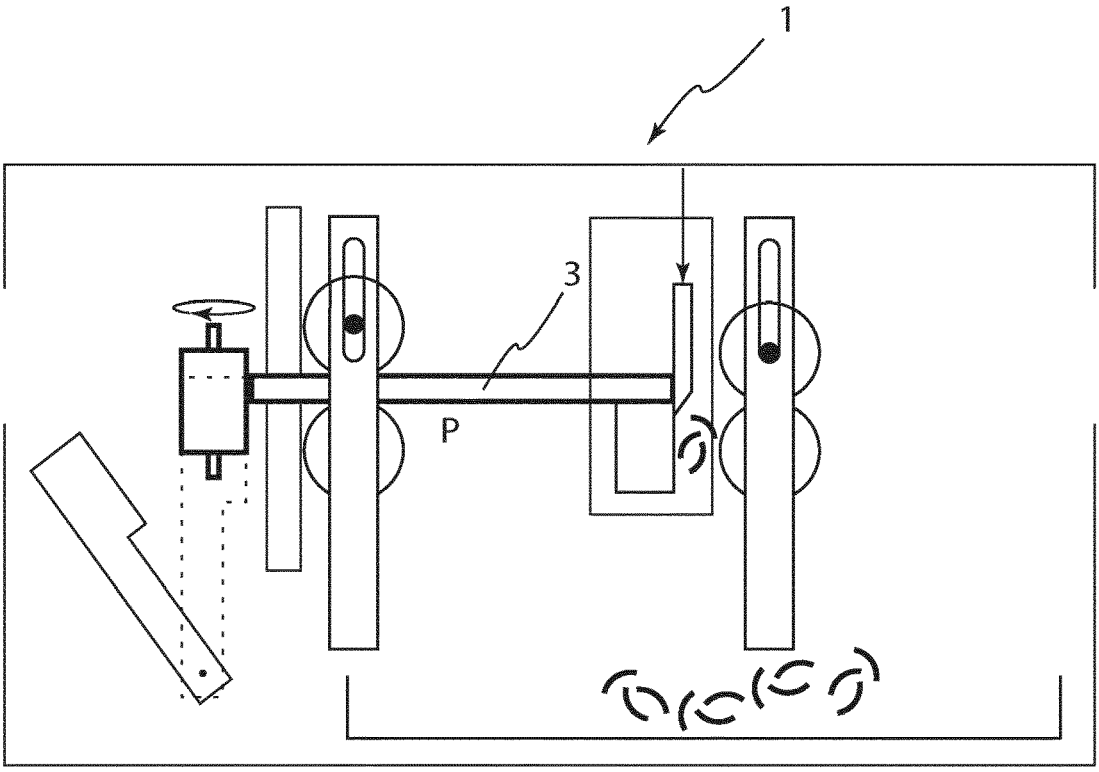
Figure 10:
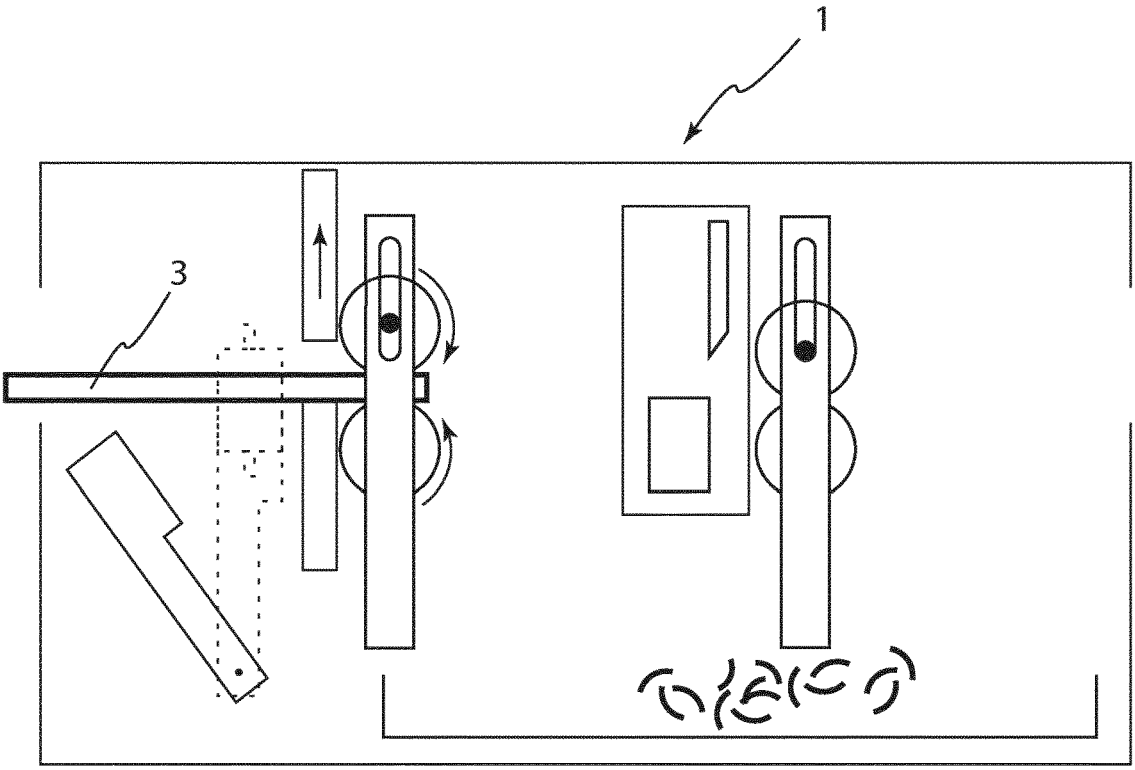

One a reference numeral has indicated which part or position or other item it relates to in one figure, it may be left out of the other figures, since all figures relate to the same embodiment and the same items are easily recognised from figure to figure.

| | |
|---|---|
| 1 | post-processing device |
| 2 | inlet |
| 3 | booklet |
| 4 | outlet |
| 5 | cutting assembly |
| 6 | knife |
| 7 | support |
| 8 | square folding assembly |
| 9 | press means |
| 10 | support member |
| 11 | transportation path |
| 12 | first feeding assembly |
| 13 | stopper means |
| 14 | abutment member |
| 15 | pieces of cut off sheets |
| 16 | waste container |
| 17 | clamping assembly |
| 18 | second feeding assembly |
| 19 | clamping member |
| P | processing position |
| P1 | stop position |
| P2 | resting position of abutment member |
| P3 | clamping position |
| P4 | open position of clamping assembly |
| D1 | predetermined distance |

DETAILED DESCRIPTION

Embodiments of the invention will hereinafter be described with reference to the appended figures which show a first embodiment of the post-processing device.

FIG. 1 shows schematically the various components and the overall layout of the post-processing device 1. The post-processing device 1 may be used in-line with a booklet maker of a printing line (not shown) to perform square folding and trimming of booklets 3 in one step without moving the booklet. During square folding, the booklet 3 it treated by applying pressure to the back/spine/'folded portion' in order to create a square-shape spine. During trimming, the opposite edge of the spine, the open end of the booklet, is cut straight.

The post-processing device 1 comprises on its right hand side an inlet 2 for receiving a booklet 3 to be post-processed an on its left hand side an outlet 4 for outputting the booklet 3 after post-processing. Of course, the whole design could as well be mirrored left-to-right to have the inlet at the left hand side and the outlet on the right hand side. Also, what left and right depends on what you deem to be the back and front of the device. The left and right references refer to the view in the figures.

The device 1 is also provided with a cutting assembly 5 comprising a knife 6 and a support 7 for supporting the booklet 3 when the knife 6 is lowered to cut the booklet 3. The cutting assembly 5 is movably attached to the post-processing device 1 and guided on linear guides for movement back and forth along the transportation path 11 between the inlet 2 and the outlet 4. The cutting assembly 5 is operatively connected to a sixth drive means (not shown), preferably in the form of an electric motor configured to control the position of the cutting assembly 5 along the linear guide. The sixth drive means is operable in response to a cutting assembly position control signal. The cutting assembly 5 is a relatively heavy, weighing in excess of 20 kg. The cutting assembly 5 comprises a knife drive mechanism with a drive means configured to move the knife 6 between a raised position in which the cutting assembly 5 is open such that a booklet 3 can be moved through the opening between the knife 6 and the support 7, such as when being conveyed towards the processing position P.

The device 1 further comprises a square folding assembly 8 comprising a press means 9 in the form of a roll for applying pressure along the spine of the booklet 3. The square folding assembly 8 is provided with a mechanism for moving the roll 9 along the spine whilst applying pressure on the roll for 9 deforming the spine to give it the desired square shape. After operation of the roll 9 along the spine, the mechanism moves the roll 9 back to a parking position away from the booklet 3.

The device 1 also comprises a conveying system configured to move the booklet 3 along a transportation path 11 as shown in FIG. 1, from the inlet 2 to the outlet 4 via the cutting assembly 5 and the square folding assembly 8.

The conveying system comprises a first feeding assembly 12 provided between the inlet 2 and the cutting assembly 5. The first feeding assembly 12 comprises a first feeding mechanism configured to control feeding of the booklet 3 relative to the first feeding assembly 12. The feeding mechanism comprises parallel roller assemblies between which the booklet 3 can be introduced and subsequently squeezed between the roller assemblies such that rotation of the roller assemblies controls movement of the booklet 3. At least one of the roller assemblies is operatively connected to a first drive means in the form of an electric motor. Alternatively, some other suitable drive means could be used. The first drive means is provided on the first feeding assembly 12 but could in other embodiments be provided remotely of the first feeding assembly 12 but operatively connected using a suitable transmission, belt drive or the like. The first drive means is operable in response to a first feed control signal to operate the first feeding mechanism.

The first feeding assembly 12 is movably attached to the post-processing device 1 and guided on linear guides for movement back and forth along the transportation path 11 between the inlet 2 and the cutting assembly 5. In other embodiments suitable non-linear guides could be used as long as the intended movement of the booklet 3 through the device 1 can still be achieved. The first feeding mechanism is configured such that a forward feeding direction of the first feeding mechanism is parallel to the direction of the linear guide. This enables feeding of the booklet 3 along a straight feeding path by translation of the first feeding assembly 12 along the linear guides as well as by operation of the first feeding mechanism, thereby increasing flexibility of positioning of the first feeding assembly 12.

The first feeding assembly 12 is operatively connected to a second drive means, preferably in the form of an electric motor, configured to control the position of the first feeding assembly 12 along the linear guide. The second drive means is operable in response to a first position control signal.

The conveying system also comprises a second feeding assembly 18 provided between the cutting assembly 5 and the square folding assembly 8. The second feeding assembly 18 comprises a second feeding mechanism configured to control feeding of the booklet 3 relative to the second feeding assembly 18. The second feeding mechanism comprises parallel roller assemblies similar to the ones of the first feeding assembly 12. At least one of the roller assemblies is operatively connected to a third drive means in the form of an electric motor. Alternatively, some other suitable drive means could be used. The third drive means is provided on the second feeding assembly 12 but could in other embodiments be provided remotely of the second feeding assembly but operatively connected using a suitable transmission, belt drive or the like. The third drive means is operable in response to a second feed control signal to operate the second feeding mechanism.

The second feeding assembly 18 is movably attached to the post-processing device 1 and guided on linear guides for movement back and forth along the transportation path 11 between the cutting assembly 5 and the square folding assembly 8. In other embodiments suitable non-linear guides could be used as long as the intended movement of the booklet 3 through the device 1 can still be achieved.

The second feeding assembly 18 is operatively connected to a fourth drive means, preferably in the form of an electric motor, configured to control the position of the second feeding assembly along the linear guide. The fourth drive means is operable in response to a second position control signal.

The post-processing device 1 further comprises a clamping assembly 17 configured to be operable between a clamping position P3 in which the clamping assembly clamps the spine portion of the booklet 3 to hold the booklet 3 static in a processing position P for processing by the square folding assembly 8 and the cutting assembly 5, and an open position P4 in which the clamping assembly 17 allows the booklet 3 to move. To enable this functionality, the clamping assembly 17 is provided with a clamping mechanism comprising at least one movable clamping member 19 operatively connected to a fifth drive means operable in response to a clamping control signal to move the clamping member 19 between an upper, open position P4 in which it does not contact the booklet 3, and a clamping position P3 in which is presses on the cover of the booklet 3 to prevent movement of the booklet 3. The clamping assembly 17 comprises a support member 10 for the booklet 3 to rest against upon pressing by the clamping member 19 but in other embodiments some other member of the post-processing device 1 could act as support.

The square folding assembly 8 is fixed to a chassis of the post-processing device 1. However, the cutting assembly 5 is movably attached to the post-processing device 1 such that the distance between the square folding assembly 8 and the cutting assembly 5 is variable by movement the cutting assembly 5. The cutting assembly 5 is relatively heavy, weighing in excess of 20 kg, and should thus be moved with care. Rapid movement of the cutting assembly 5 is not advisable since it would risk causing unnecessary vibrations and wear.

The post-processing device 1 further comprises a stopper means 13 comprising an abutment member 14 movable between a stop position P1 in which it blocks the transportation path 11 at a position adjacent the square folding assembly 8 to thereby define the processing position P, and a resting position P2 in which the abutment member 14 is moved out of the way of the square folding assembly 8 such that the square folding assembly 8 is free to operate on the booklet 3. In other embodiments, the stopper means 13 may instead of the physical abutment member comprise an optical or other suitable sensor adapted to detect the position of the booklet 3 and output a signal indicating that the booklet has reached the processing position P. However, a physical stop is advantageous since it enables a certain amount of correction of misalignment of the booklet 3 by pressing of the booklet 3 against the abutment member 14. At such pressing of the booklet 3, the booklet rotates slightly and aligns with its spine along the abutment member 14 whilst gliding slightly relative to the feeding mechanism of the second feeding assembly 18.

Also, the first 12 and second 18 feeding assemblies are relatively light weight as compared to the cutting assembly 5, and can therefore be quickly accelerated and moved back and forth to carry out their functions within the post-processing device 1 without causing excessive vibrations.

Altogether, the post-processing device 1 is advantageous at least since it has a small footprint whilst being able to quickly perform both square folding and trimming and yet being able to do this for a wide variety of booklet sizes.

A method of operating the post-processing device 1 is described below. The method may be implemented in the form of a computer program to be run on a computer adapted to control the post-processing device 1.

Initially, the type of size of the booklet 3 to processed is determined such that the suitable distance between the cutting assembly 5 and the square folding assembly 8 can be determined. This can for example be based on a manual setting or on a control signal. Once the distance D1 is determined, the cutting assembly 5 is moved to the corresponding position at a predetermined distance D1 from the square folding assembly 8 by operation of the third drive means. Now is a good time to operate the stopper means 13 to bring the abutment member 14 to the stop position P1 thereby providing a physical stop defining the processing position P. The first feeding assembly 12 is then moved to the inlet 2 and operated to receive, grab and convey a booklet 3 from the inlet 2 to the cutting assembly 5. When adjacent the cutting assembly 5, the first feeding mechanism is operated to move the booklet 3 forward relative to the first feeding assembly 12 by operation of the first feeding mechanism until the booklet 3 is within reach of the second feeding assembly 18. In this embodiment, the distance between the roller assemblies of each feeding mechanism is dynamically adjustable by a drive means in response to a control signal for optionally gripping or releasing a booklet 3 as needed. Then, the second feeding assembly is operated to grab and convey the booklet 3 from the cutting assembly to the processing position P by forcing the booklet 3 until it abuts the abutment member 14 of the stopper means 13, which has already been brought to its stop position P1 as described above.

The clamping assembly 17 is operated to clamp the booklet 3 in the processing position P and the stopper means 13 is subsequently operated to move the abutment member 14 to its resting position P2, thereby allowing operation of the square folding assembly 8 on the spine without conflicting with the abutment member 14.

The square folding assembly 8 and the cutting assembly 5 are then operated to square fold and cut the booklet 3 respectively whilst clamped in the processing position P. Pieces of cut off sheets 15 fall down into a waste container 16 which has to be emptied every now and then.

After square folding and trimming is finished, the clamping assembly 17 is operated to bring it to its open position. Then, the second feeding assembly 18 is operated to convey the booklet 3 towards the outlet 4. Further feeding mechanisms (not shown) may be provided adjacent the outlet 4 to assist in handling of the finished booklet 3.

Hence, after setting the distance, a plurality of similar booklets may be processed by repeating the other steps.

In other embodiments, the square folding and trimming operations could of course be performed one after the other in any order, however whilst keeping the booklet 3 static in the processing position P. That would of course take longer time than performing the operations simultaneously.

Further, it should be understood that the numbering of the drive means is only for reference and does not imply that a specific number of drive means do exist in the respective embodiment.

The invention claimed is:

1. A post-processing device comprising:

an inlet for receiving a booklet to be post-processed, an outlet for outputting the booklet after post-processing, a cutting assembly for cutting away an outer portion of sheets of the booklet, said cutting assembly comprising a knife and a support, a square folding assembly comprising a press for applying pressure along a spine of the booklet for deforming the spine to a desired square shape, a conveying system configured to move the booklet along a transportation path from the inlet to the outlet via the cutting assembly and the square folding assembly, the conveying system comprises a first feeding assembly provided between the inlet and the cutting assembly, the first feeding assembly comprises a first feeding mechanism configured to control feeding of the booklet relative to the first feeding assembly, the first feeding assembly is movably attached to the post-processing device and guided for movement back and forth along the transportation path between the inlet and the cutting assembly, the conveying system comprises a second feeding assembly provided between the cutting assembly and the square folding assembly, the second feeding assembly comprises a second feeding mechanism configured to control feeding of the booklet relative to the second feeding assembly, and a clamping assembly configured to be operable between a clamping position in which the clamping assembly clamps the spine of the booklet to hold the booklet static in a processing position for processing by the square folding assembly and the cutting assembly, and an open position in which the clamping assembly allows the booklet to move, at least one of the cutting assembly or the square folding assembly being movably attached to the post-processing device such that a distance between the square folding assembly and the cutting assembly is variable by movement of at least one of the cutting assembly or the square folding assembly.

2. The post-processing device according to claim 1, wherein the second feeding assembly is movably attached to the post-processing device and guided for movement back and forth along the transportation path between the cutting assembly and the square folding assembly.

3. The post-processing device according to claim 2, wherein the clamping assembly is provided adjacent the square folding assembly.

4. The post-processing device according to claim 2, wherein:

the first feeding assembly is mounted on a linear guide, and the first feeding mechanism is configured such that a forward feeding direction of the first feeding mechanism is parallel to a direction of the linear guide.

5. The post-processing device according to claim 2, wherein the post-processing device further comprises a stopper comprising an abutment member movable between a stop position in which it blocks the transportation path at a position adjacent the square folding assembly to thereby define the processing position, and a resting position in which the abutment member is moved out of the way of the square folding assembly such that the square folding assembly is free to operate on the booklet.

6. The post-processing device according to claim 1, wherein the clamping assembly is provided adjacent the square folding assembly.

7. The post-processing device according to claim 6, wherein the post-processing device further comprises a stopper comprising an abutment member movable between a stop position in which it blocks the transportation path at a position adjacent the square folding assembly to thereby define the processing position, and a resting position in which the abutment member is moved out of the way of the square folding assembly such that the square folding assembly is free to operate on the booklet.

8. The post-processing device according to claim 1, wherein:

the first feeding assembly is mounted on a linear guide, and the first feeding mechanism is configured such that a forward feeding direction of the first feeding mechanism is parallel to a direction of the linear guide.

9. The post-processing device according to claim 8, wherein the post-processing device further comprises a stopper comprising an abutment member movable between a stop position in which it blocks the transportation path at a position adjacent the square folding assembly to thereby define the processing position, and a resting position in which the abutment member is moved out of the way of the square folding assembly such that the square folding assembly is free to operate on the booklet.

10. The post-processing device according to claim 1, wherein the post-processing device further comprises a stopper comprising an abutment member movable between a stop position in which it blocks the transportation path at a position adjacent the square folding assembly to thereby define the processing position, and a resting position in which the abutment member is moved out of the way of the square folding assembly such that the square folding assembly is free to operate on the booklet.

11. The post-processing device according to claim 10, wherein the abutment member is parallel to the knife of the cutting assembly.

12. A method of operating the post-processing device according to claim 1, comprising steps of:

b) moving the at least one of the square folding assembly or the cutting assembly to be a predetermined distance apart, c) operating the first feeding assembly to receive, grab and convey a booklet from the inlet to the cutting assembly, d) operating the first feeding mechanism to move the booklet forward relative to the first feeding assembly until the booklet is within reach of the second feeding assembly, e) operating the second feeding assembly to grab and convey the booklet from the cutting assembly to the processing position, f) operating the clamping assembly to clamp the booklet in the processing position, h) operating the square folding assembly and the cutting assembly to square fold and cut the booklet respectively, whilst clamped in the processing position, i) operating the clamping assembly to bring it to its open position, and j) operating the second feeding assembly to convey the booklet towards the outlet.

13. The method according to claim 12, wherein the method comprises a step a) to be performed any time before step d), said step a) comprising of operating a stopper to bring an abutment member to a stop position, thereby providing a physical stop defining the processing position, the method further comprises between steps f) and h) a step g) of operating the stopper to move the abutment member to its resting position.

14. The post-processing device according to claim 1, wherein the clamping assembly is provided adjacent the square folding assembly.

15. The post-processing device according to claim 1, wherein:

the first feeding assembly is mounted on a linear guide, and the first feeding mechanism is configured such that a forward feeding direction of the first feeding mechanism is parallel to a direction of the linear guide.

16. The post-processing device according to claim 1, wherein:

the clamping assembly is provided adjacent the square folding assembly, the first feeding assembly is mounted on a linear guide, and the first feeding mechanism is configured such that a forward feeding direction of the first feeding mechanism is parallel to a direction of the linear guide.

17. The post-processing device according to claim 1, wherein the post-processing device further comprises a stopper comprising an abutment member movable between a stop position in which it blocks the transportation path at a position adjacent the square folding assembly to thereby define the processing position, and a resting position in which the abutment member is moved out of the way of the square folding assembly such that the square folding assembly is free to operate on the booklet.

18. A method of operating the post-processing device according to claim 1, comprising:

moving the at least one of the square folding assembly or the cutting assembly to be a predetermined distance apart.

* * * * *